US007526235B2

(12) United States Patent
Furukawa

(10) Patent No.: US 7,526,235 B2
(45) Date of Patent: Apr. 28, 2009

(54) IMAGE-FORMING DEVICE

(75) Inventor: Toshio Furukawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 212 days.

(21) Appl. No.: 11/236,854

(22) Filed: Sep. 28, 2005

(65) Prior Publication Data

US 2006/0072941 A1 Apr. 6, 2006

(30) Foreign Application Priority Data

Sep. 28, 2004 (JP) ..... 2004-281924

(51) Int. Cl.
*G03G 15/01* (2006.01)

(52) U.S. Cl. ..... 399/231

(58) Field of Classification Search ..... 399/231; 430/47.2

See application file for complete search history.

(56) References Cited

U.S. PATENT DOCUMENTS

| | | | | |
|---|---|---|---|---|
| 5,797,070 | A * | 8/1998 | Waki et al. | 399/149 |
| 5,993,101 | A * | 11/1999 | Kohno et al. | 403/305 |
| 6,266,073 | B1 * | 7/2001 | Yergenson | 347/115 |
| 6,930,786 | B2 * | 8/2005 | Kataoka et al. | 358/1.12 |
| 7,135,260 | B2 * | 11/2006 | Miyakawa et al. | 430/45.3 |
| 2002/0186980 | A1 * | 12/2002 | Tsuruya et al. | 399/49 |
| 2003/0152857 | A1 * | 8/2003 | Sugiura et al. | 430/109.2 |
| 2005/0281591 | A1 * | 12/2005 | Kitozaki et al. | 399/258 |

FOREIGN PATENT DOCUMENTS

JP 2002031933 1/2002

OTHER PUBLICATIONS

Weinmann, Elaine, et al., "Photoshop 6 for Wlndows and Macintosh: Visual Quickstart Guide", Jan. 25, 2001, Peachpit Press, Print ISBN-10: 0-201-71309-8, Chapter 2.*

* cited by examiner

*Primary Examiner*—David M Gray
*Assistant Examiner*—Bryan Ready
(74) *Attorney, Agent, or Firm*—Banner & Witcoff, Ltd.

(57) ABSTRACT

An image-forming device includes 1st to $N_{th}$ image bearing members, 1st to $N_{th}$ developing units provided in one-to-one correspondence with the 1st to $N_{th}$ image bearing members, and a transfer unit. N is an integer number equal to or greater than two. The 1st to $N_{th}$ image members have 1st to $N_{th}$ surfaces respectively. The 1st to $N_{th}$ electrostatic latent images are formable on the 1st to $N_{th}$ surface respectively. The 1st to $N_{th}$ developing units have 1st to $N_{th}$ monochromatic developers respectively. The 1st monochromatic developer is of monochromatic black and has a toner particle substantially spherical in shape. The 1st to $N_{th}$ developing units develop the 1st to $N_{th}$ electrostatic latent images with the 1st to $N_{th}$ monochromatic developers respectively in order to form 1st to $N_{th}$ developer images respectively. The transfer unit transfers sequentially the 1st to $N_{th}$ developer images to a recipient in a superimposed manner in order of the 1st to $N_{th}$ developer image.

18 Claims, 5 Drawing Sheets

FIG.4

| EASE OF REV-TRANS | FOR THIRD DEVLOPING UNIT | FOR FOURTH DEVLOPING UNIT |
|---|---|---|
| SMALL | WHICH OF FIRST OR SECOND TONER? ==> SECOND TONER | WHICH OF SECOND OR THIRD TONER? ==> THIRD TONER |
| MIDDLE | | WHICH OF FIRST OR SECOND TONER? ==> SECOND TONER |
| LARGE | | WHICH OF FIRST OR THIRD TONER? ==> THIRD TONER |

IMAGE-FORMING DEVICE

BACKGROUND OF THE INVENTION

1. Field of the Invention

The present invention relates to an image-forming device to form a multi-color image.

2. Description of Related Art

A conventional image-forming device, such as Japanese Patent application publication No. 2002-31933, forms a multi-color image as follows. Firstly, a plurality of developing units forms developer images sequentially on a plurality of corresponding image bearing members (or on one image bearing member, in the four-cycle method) on which latent electrostatic images are formed. Then, those developer images are transferred sequentially to a transfer recipient such as a sheet of paper or an intermediate transfer body.

SUMMARY OF THE INVENTION

It has recently been established that reverse transfer occurs when such an image-forming device forms a multi-color image.

Part of the developer that has been transferred to the transfer recipient from one image bearing member are charged to a polarity opposite to the polarity to which the developing unit has charged. When the second or later image bearing members performs transferring, the developer charged to the opposite polarity is reverse-transferred to the second or later image bearing members due to the reverse transfer.

The reverse transfer is more likely to occur as the amount of developer (amount of toner) that has been transferred to the transfer recipient increases. With the tandem method, for example, the amount of developer involved in the reverse transfer generally increases with later image bearing members positioned on the downstream side in the direction in which the paper is conveyed.

A conventional image-forming device with the simultaneous development/cleaning method (also called the cleanerless method) is not provided with a cleaning device for recovering waste developer. Therefore, if the waste developer (reverse transfer toner) that has been reverse-transferred to the image bearing members is recovered into the developing unit, the developer for the original colors will be mixed with the waste developer.

When charge capability of the waste developer (reverse-transferred toner) that has been reverse-transferred to the image bearing members is higher than that of the developer for the original colors, the waste developer rather than the developer for the original colors will tend to be transferred to the transfer recipient in the development, causing color mixing. In addition, muddying can also occur easily due to difference in charge amount, causing poor image quality.

Furthermore, if the cleaning effect is not sufficiently pronounced even when a cleaning device is provided with a recovering waste developer, the color mixing and muddying can occur in a similar manner to those with the simultaneous development/cleaning method.

In view of the foregoing, it is an objective of the present invention to provide an image-forming device that can form images while suppressing the effects of reverse transfer.

In order to attain the above and other objects, the present invention provides an image-forming device including 1st to $N_{th}$ image bearing members, 1st to $N_{th}$ developing units provided in one-to-one correspondence with the 1st to $N_{th}$ image bearing members, and a transfer unit. N is an integer number equal to or greater than two. The 1st to $N_{th}$ image members have 1st to $N_{th}$ surfaces respectively. The 1st to $N_{th}$ electrostatic latent images are formable on the 1st to $N_{th}$ surface respectively. The 1st to $N_{th}$ developing units have 1st to $N_{th}$ monochromatic developers respectively. The 1st monochromatic developer is of monochromatic black and has a toner particle substantially spherical in shape. The 1st to $N_{th}$ developing units develop the 1st to $N_{th}$ electrostatic latent images with the 1st to $N_{th}$ monochromatic developers respectively in order to form 1st to $N_{th}$ developer images respectively. The transfer unit transfers sequentially the 1st to $N_{th}$ developer images to a recipient in a superimposed manner in order of the 1st to $N_{th}$ developer image.

Another aspect of the present invention provides an image-forming device including a plurality of image bearing members, a plurality of developing units and a transfer unit, The plurality of image bearing members includes 1st to 4th image bearing members. The 1st to 4th image members have 1st to 4th surfaces respectively. 1st to 4th electrostatic latent images are formable on the 1st to 4th surface respectively. The plurality of developing units includes 1st to 4th developing units provided in one-to-one correspondence with the 1st to 4th image bearing members. The 1st to 4th developing units have 1st to 4th monochromatic developers respectively. The 1st monochromatic developer is of monochromatic black and has a toner particle substantially spherical in shape. The 1st to 4th developing units develop the 1st to 4th electrostatic latent images with the 1st to 4th monochromatic developers respectively in order to form 1st to 4th developer images respectively. A total amount of the 2nd monochromatic developer on the 2nd surface and the 3rd monochromatic developer on the 3rd surface is less than an amount of the 1st monochromatic developer on the 1st surface. The transfer unit transfers the 1st to 4th developer images to a recipient in a superimposed manner in order of the 1st to 4th developer image in order to form a black image.

Another aspect of the present invention provides an image-forming method including steps (a) to (d). The step (a) forms 1st to $N_{th}$ electrostatic latent images on a surface formed on an image bearing members, N being an integer equal to or greater than two. The step (b) develops the 1st to $N_{th}$ electrostatic latent images with 1st to $N_{th}$ monochromatic developers respectively in order to form 1st to $N_{th}$ developer images respectively, wherein the $N-1_{th}$ monochromatic developer being of monochromatic yellow. The (c) transfers sequentially the 1st to $N_{th}$ developer images to a recipient in a superimposed manner in order of the 1st to $N_{th}$ developer image. The step (d) removes residual developer that adheres to each image bearing member while developing each electrostatic latent image.

Another aspect of the present invention provides an image-forming device including at least one image bearing member, a plurality of developing units and a transfer unit. A plurality of electrostatic latent images is formable on at least one image bearing member. The plurality of developing units include 1st to $N_{th}$ developing units. the 1st to $N_{th}$ developing units have 1st to $N_{th}$ monochromatic developers respectively. The 1st monochromatic developer is of monochromatic black and has a toner particle substantially spherical in shape. The 1st to $N_{th}$ developing units develop the plurality of electrostatic latent images with the 1st to $N_{th}$ monochromatic developers respectively in order to form 1st to $N_{th}$ developer images respectively. The transfer unit transfers the 1st to $N_{th}$ developer images to a recipient in a superimposed manner in order of the 1st to $N_{th}$ developer image.

Another aspect of the present invention provides an image-forming device including at least one image bearing member, a plurality of developing units and a transfer unit. 1st to 4th electrostatic latent images are formable on at least one image bearing member. The plurality of developing units includes 1st to 4th developing units provided in one-to-one correspondence with the 1st to 4th image bearing members. The 1st to 4th developing units have 1st to 4th monochromatic developers respectively. The 1st monochromatic developer is of monochromatic black. The 1st to 4th developing units develop the 1st to 4th electrostatic latent images with the 1st to 4th monochromatic developers respectively in order to form 1st to 4th developer images respectively. A total amount of the 2nd monochromatic developer and the 3rd monochromatic developer on the image bearing member is less than an amount of the 1st monochromatic developer on the image bearing member. The transfer unit transfers the 1st to 4th developer images to a recipient in a superimposed manner in order of the 1st to 4th developer image in order to form a black image.

Another aspect of the present invention provides an image-forming device including a plurality of image bearing members, a plurality of developing units, a transfer unit and a cleaning member. The plurality of image bearing members include 1st to $N_{th}$ image bearing members. N is an integer number equal to or greater than two. The 1st to $N_{th}$ image members have 1st to $N_{th}$ surfaces respectively. 1st to $N_{th}$ electrostatic latent images are formable on the 1st to $N_{th}$ surface respectively. The plurality of developing units include 1st to $N_{th}$ developing units provided in one-to-one correspondence with the 1st to $N_{th}$ image bearing members. The 1st to $N_{th}$ developing units have 1st to $N_{th}$ monochromatic developers respectively. The $N-1_{th}$ monochromatic developer is of monochromatic yellow. The 1st to $N_{th}$ developing units develop the 1st to $N_{th}$ electrostatic latent images with the 1st to $N_{th}$ monochromatic developers respectively in order to form 1st to $N_{th}$ developer images respectively. The transfer unit transfers sequentially the 1st to $N_{th}$ developer images to a recipient in a superimposed manner in order of the 1st to $N_{th}$ developer image. The cleaning member removes residual developer that adheres to each image bearing member after each developer image is transferred to the recipient. Each developing unit develops each electrostatic latent image while removing the residual developer with the cleaning member.

BRIEF DESCRIPTION OF THE DRAWINGS

The above and other objects, features and advantages of the invention will become more apparent from reading the following description of the preferred embodiments taken in connection with the accompanying drawings in which:

FIG. 4 is illustrative of the sequence in which developer images are formed and the ease of reverse transfer; and.

DETAILED DESCRIPTION OF THE PREFERRED EMBODIMENTS

Figure 1:
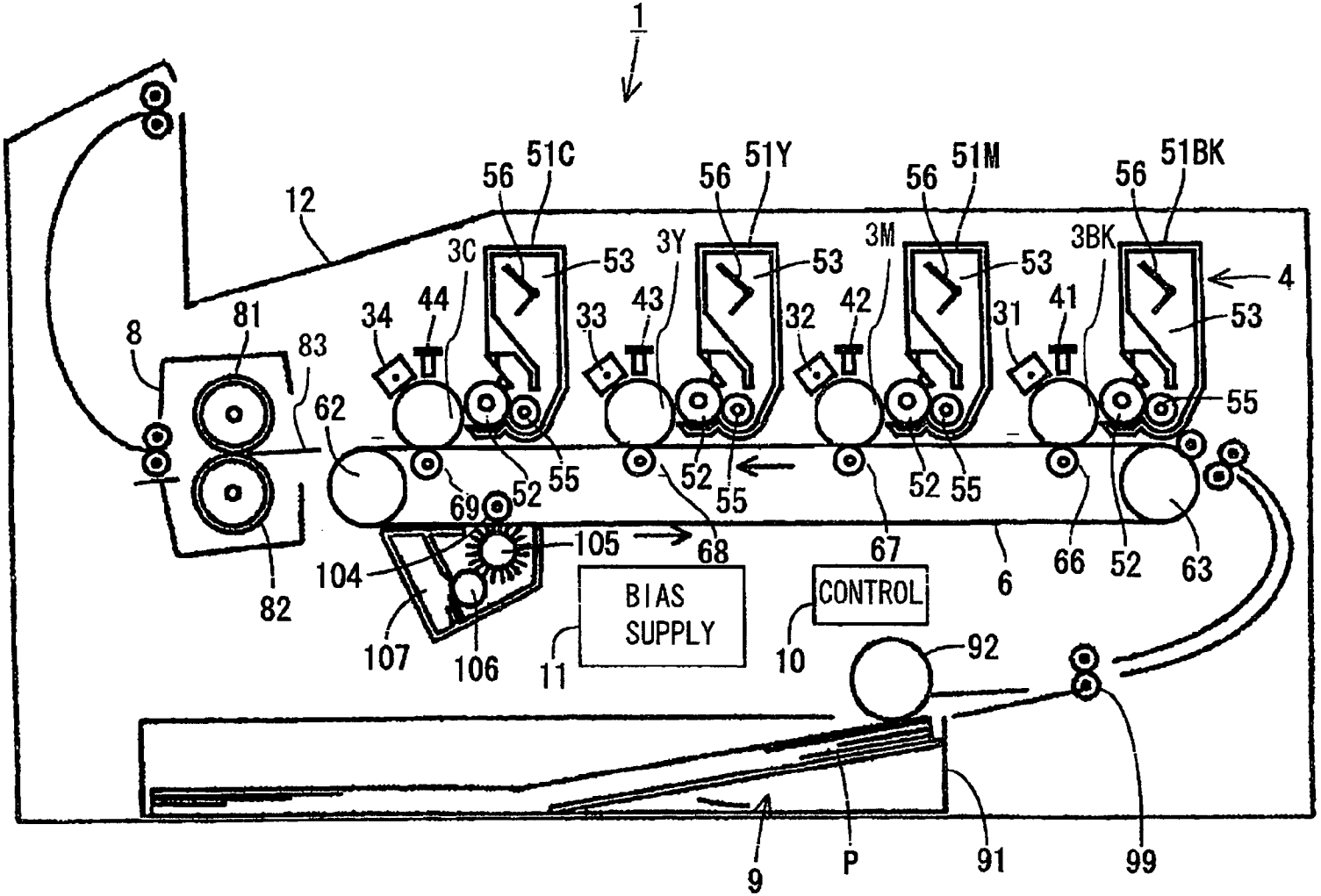
FIG. 1 is a section taken through the side of essential components of a color laser printer in a first embodiment.

An image-forming device according to preferred embodiments of the present invention will be described while referring to the accompanying drawings wherein like parts and components are designated by the same reference numerals to avoid duplicating description.

A first embodiment of the present invention will be described with reference to FIGS. 1 to 4. FIG. 1 is a side sectional view of a color laser printer 1 according to the first embodiment. As shown in FIG. 1, the color laser printer 1 has a visible image formation portion 4, a paper conveyor belt 6, a fixing portion 8, a paper supply portion 9, a stacker 12, a control portion 10, and a bias supply unit 11. The color laser printer 1 forms a multi-color image by sequentially overlaying four color toner images on paper P, where the four colors corresponds to image data that is input from the exterior.

The visible image formation portion 4 has four developing units 51BK, 51M, 51Y, and 51C; four photosensitive drums 3BK, 3M, 3Y, and 3C being one-to-one correspondence with the developing units 51BK, 51M, 51Y, and 51C; four chargers 31, 32, 33, and 34 being one-to-one correspondence with the developing units 51BK, 51M, 51Y, and 51C; and four exposure devices 41, 42, 43, and 44 being one-to-one correspondence with the developing units 51BK, 51M, 51Y, and 51C. The developing units 51BK, 51M, 51Y, and 51C accommodates black (BK), magenta (M), yellow (Y), and cyan (C) toner respectively. The capital letters used as suffixes for the developing units in FIG. 1 refer to the color of the toner housed in the corresponding developing units.

There are two methods of forming a black-colored image: one in which only a monochromatic black developer is used and another in which developers of other colors (such as yellow, cyan and magenta, or red, green, and blue) are overlaid on black-colored developer (mixed-color black development). Mixed-color black development produces blacks of a much higher image quality than monochromatic black development. Therefore, the mixed-color black development is used for forming a black-colored image in the present embodiment.

The configuration of each of the structural components will be described in detail as follows. The four photosensitive drums 3BK, 3M, 3Y, and 3C that are formed of a member of a substantially circular cylindrical form are disposed rotatably, spaced substantially equidistantly along a line in the horizontal direction (the widthwise direction in the plane of the paper in FIG. 1). The substantially circular cylindrical material of each of the photosensitive drums 3BK, 3M, 3Y, and 3C is an aluminum base member on which a positively-charged photosensitive layer is formed, for example. The aluminum base member is grounded to the ground line of the color laser printer 1.

Figure 2:
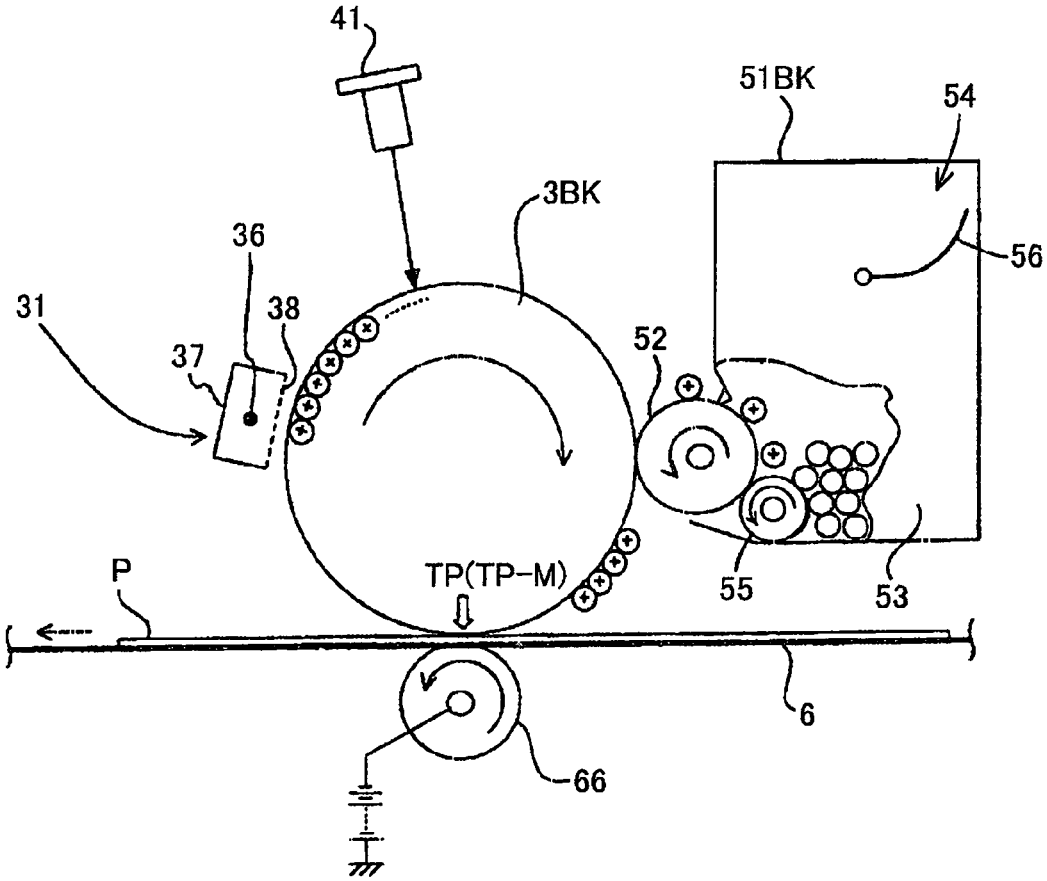
FIG. 2 shows the configuration in the vicinity of a photosensitive drum in the first embodiment.

Each of the four chargers 31 to 34 is a scorotron type of charger. FIG. 2 shows the detailed configuration of the charger 31 that charges the photosensitive drum 3BK for forming the black toner image. The charger 31 has a charge wire 36 and a shielding case 37. The charge wire 36 extends to the axis direction of the photosensitive drum 3BK (the direction into the paper in FIG. 2) facing the surface of the photosensitive drum 3BK. The shielding case 37 houses the charge wire 36 and is open towards the photosensitive drum 3BK side. The shielding case 37 is provided with a grid 38 over the open portion.

The surface of the photosensitive drum 3BK is charged to a positive polarity (such as +700 V) when a high voltage is applied to the charge wire 36. The charge on the surface of the photosensitive drum 3BK and the voltage of the grid are kept at substantially the same potential by applying a constant voltage to this grid 38. The chargers 32, 33, and 34 that are provided to correspond to the other photosensitive drums 3M, 3Y, and 3C have the same structure as the charger 31.

The exposure device 41 will be described referring to FIG. 2. The exposure device 41 exposes the photosensitive drum 3BK for forming a latent electrostatic image on the surface of the photosensitive drum 3BK. As shown in FIG. 2, the exposure device 41 is disposed on the downstream side of the charger 31 with respect to the direction of rotation of the photosensitive drum 3BK (clockwise in this figure). A light source of the exposure device 41 outputs a laser beam corresponding to one color component of image data (in this case, black) that is input from the exterior. The laser beam is scanned by the mirrored surfaces of a polygon mirror (not shown) that is driven to rotate by a polygon motor (also not shown), to illuminate the surface of the photosensitive drum 3BK. Note that large portions of the exposure devices 41 to 44 are omitted from FIGS. 1 and 2; only the portions that emit the laser beam are shown therein.

When the surface of the photosensitive drum 3BK is illuminated by the laser beam, the surface potential of the illuminated portions drops (to +150 V, by way of example) to form a latent electrostatic image on the surface of the photosensitive drum 3BK. The other exposure devices 42, 43, and 44 that are disposed facing the corresponding photosensitive drums 3M, 3Y, and 3C have the same configuration as that of the above-described exposure device 41, and each outputs a laser beam for the corresponding color, based on image data that is input from the exterior.

The first developing unit 51BK, which develops the latent electrostatic image formed by black toner, will be described referring to FIG. 2. As shown in FIG. 2, the developing unit 51BK has a toner hopper 54 to house the toner, a supply roller 55 to supply the toner, and a developing roller 52 to bear the toner, within a developing unit case 53.

The toner hopper 54 is an interior space in the developing unit case 53 and accommodates black toner. An agitator 56 is provided at one end portion within the toner hopper 54. In the present embodiment, the toner housed in the toner hopper 54 is positively charged, non-magnetic, single-component developer that is formed from a suspended polymer or emulsified polymer. The particles of the toner are substantially spherical to have excellent fluidity.

The supply roller 55 has a roller shaft and an electrically conductive sponge material coated around the metal roller shaft. The supply roller 55 is disposed at the bottom part within the toner hopper 54. The supply roller 55 is supported rotatably in the same direction as the developing roller 52 (in the counterclockwise direction in FIG. 2), facing the developing roller 52.

The developing roller 52 is disposed rotatably at a position at which the developing roller 52 is in mutual contact with the supply roller 55. The developing roller 52 is configured of a circular cylindrical member that is made of electrically conductive silicone rubber or the like as a base member. The surface of the developing roller 52 is formed with a coating of a rubber material or a resin comprising fluoride.

The developing roller 52 is disposed in contact with the photosensitive drum 3BK on the downstream side of the exposure device 41 in the direction of rotation of the photosensitive drum 3BK. The developing unit 51BK supplies the toner charged to a positive polarity for the developing roller 52 as a uniform thin layer. Inverted developing method is used to form a toner image while providing the latent electrostatic image of a positive polarity that has been formed on the photosensitive drum 3BK with the positively-charged toner, at the contact portion between the developing roller 52 and the photosensitive drum 3BK.

The other developing units 51M, 51Y, and 51C each have a configuration that is similar to that of developing unit 51BK shown in FIG. 2, except that the colors of the toner accommodated therein are different (these developing units hold magenta, yellow, and cyan toner, respectively).

The paper supply portion 9 is provided in the lowermost portion of the color laser printer 1 and is configured of an accommodation tray 91 to accommodate the paper P and a pick-up roller 92 to transmit the paper. The paper P that is accommodated in the accommodation tray 91 is taken out one sheet at a time by the pick-up roller 92 and is transmitted to the paper conveyor belt 6 via conveyor rollers 99 or the like.

The paper conveyor belt 6 is formed in a loop and suspended between a drive roller 62 and a driven roller 63. The paper conveyor belt 6 can run integrally with the paper P supported on the upper surface of the paper conveyor belt 6. The width of the paper conveyor belt 6 is narrower than the width of the photosensitive drums 3BK, 3M, 3Y, and 3C. Four transfer rollers 66, 67, 68, and 69 are provided at positions where the four transfer rollers 66, 67, 68, and 69 face the corresponding photosensitive drums 3BK, 3M, 3Y, and 3C via the paper conveyor belt 6 respectively.

When the drive roller 62 rotates, the paper conveyor belt 6 in a loop also rotates as shown in FIG. 1. The paper P that has been transmitted by the conveyor rollers 99 or the like is conveyed sequentially between each of the photosensitive drums 3BK, 3M, 3Y, and 3C and the surface of the paper conveyor belt 6, then on to the fixing portion 8.

A suitable transfer bias that is controlled at −10 to −15 μA, by way of example, is applied between each of the transfer rollers 66 to 69 and the corresponding photosensitive drums 3BK, 3M, 3Y, and 3C in order to electrostatically transfer the toner image that is formed on each photosensitive drum in sequence to the paper P that is conveyed by the paper conveyor belt 6. Specifically, a voltage having a polarity (in the present embodiment, negative polarity) opposite to that (in the present embodiment, positive polarity) of the charge on each of the corresponding photosensitive drums 3BK, 3M, 3Y, and 3C is applied to each of the four transfer rollers 66, 67, 68, and 69.

Taking the toner image formed by black toner as an example, if the transfer bias of a high voltage of a negative polarity is applied to the transfer roller 66, the toner image on the photosensitive drum 3BK is transferred to the paper P at the position at which the photosensitive drum 3BK faces the transfer roller 66, in other words, at a transfer nip portion TP at which the paper P is in contact with the photosensitive drum 3BK.

In other words, the application of the transfer bias generates an electric field from the photosensitive drum 3BK to the transfer roller 66. The toner image of a positive polarity on the photosensitive drum 3BK transfers to the paper P electrostatically due to the electric field transfers. The transfer of the toner images on the other photosensitive drums 3M, 3Y, and 3C is done in the same way.

Thus, the toner images of the corresponding colors are transferred sequentially in order of black, magenta, yellow, and cyan by the application of the transfer bias to the corresponding transfer rollers 67, 68, and 69. In other word, the desired multi-color image is created by overlaying toner images sequentially in order of black, magenta, yellow, and cyan onto the paper P. Note that the use of constant-current control over the transfer bias is cited merely as an example, and thus another control method could be used, such as constant-voltage control.

A cleaning brush 105 is disposed at the downstream of the drive roller 62, facing the surface of the paper conveyor belt 6. The cleaning brush 105 has a brush provided around the periphery of a substantially circular cylindrical member whose axis extends across the width of the paper conveyor belt 6. The cleaning brush 105 rotates in contact with the paper conveyor belt 6. A bias voltage is applied between the cleaning brush 105 and an electrode roller 104 that is provided at a position on the other side of the paper conveyor belt 6 and faces to the cleaning brush 105.

A recovery roller 106 and a collection box 107 are provided in the vicinity of the cleaning brush 105. The recovery roller 106 removes toner that adheres to the cleaning brush 105. The collection box 107 accumulates the toner removed from the cleaning brush 105 by the recovery roller 106.

The fixing portion 8 is configured of a heating roller 81, a pressure roller 82 and a fixing sheet 83. The paper P, on which a multi-color image formed of toner images in four colors is born, is conveyed between the heating roller 81 and the pressure roller 82 via the fixing sheet 83. The heating roller 81 heats and the pressure roller 82 press the paper P to fix the multi-color image to the paper P.

The stacker 12 is provided on the upper surface of the color laser printer 1 and on the paper discharge side of the fixing portion 8. The stacker 12 holds the paper P that is discharged from the fixing portion 8.

The control portion 10 is provided with a well-known CPU to control all the operations of the color laser printer 1. The control portion 10 also controls the bias supply unit 11 to apply the transfer bias to each of the transfer rollers 66, 67, 68, and 69; the cleaning bias between the electrode roller 104 and the cleaning brush 105, and the voltage to each of the chargers 31 to 34.

The color laser printer 1 of the present embodiment uses a method simultaneous development/cleaning method by which residual toner that has not been transferred, and thus remains on the photosensitive drum surfaces after the transfer of the toner images from the photosensitive drums 3BK, 3M, 3Y, and 3C onto the paper P, is recovered into the toner hopper 54 via the developing roller 52 and the supply roller 55 while developing being performed.

Although the precise mechanism that results in the reverse transfer is still not clear, the cause of the reverse transfer, more specifically, the cause of reverse-charging of toner, is deduced from the results of inspection. When a strong electrical field is generated between the toner and the paper, the discharge occurs within the toner layer that has been transferred onto the paper P. When the discharge occurs, the toner is charged to opposite polarity. When toner of different colors is transferred sequentially, the later toner is overlaid onto the toner that has been already transferred on the paper P. The overall potential is increased due to the charge possessed by the toner layer itself and the electrostatic capacitance generated by the toner layer, causing generating a discharge within the toner layer to charge the upper layer to a negative polarity.

Figure 3A:
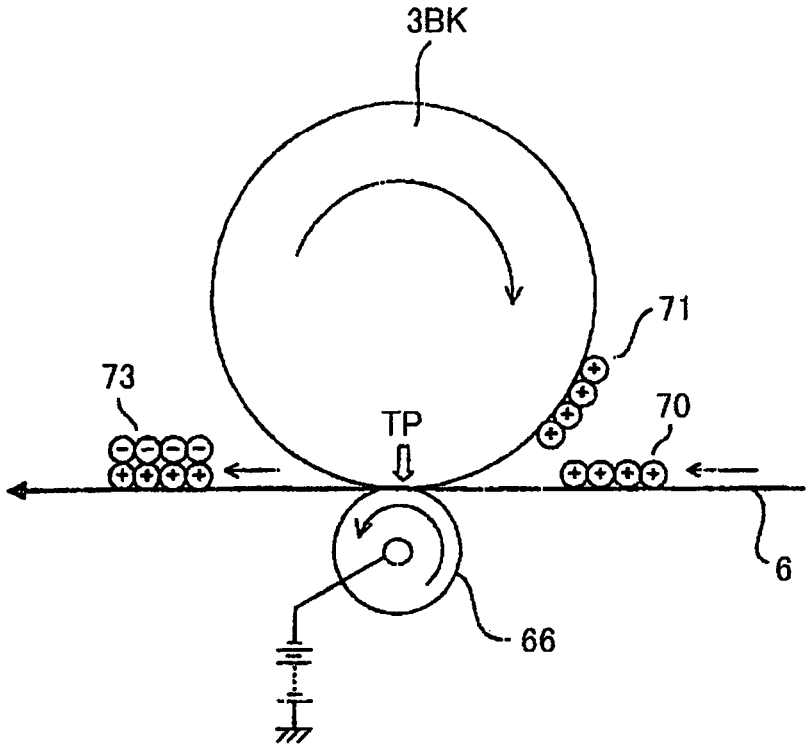
FIG. 3 is illustrative of the cause of reverse-charging.
Figure 3B:
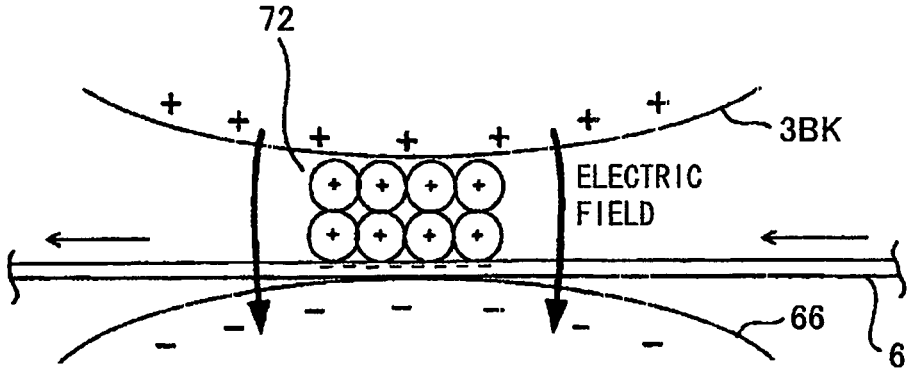

More specifically, as shown in FIG. 3(*a*), a toner image (of positive polarity) 71 on each of the photosensitive drums 3BK, 3M, 3Y, and 3C is transferred onto a toner image 70 of a positive polarity onto the paper (not shown), at corresponding transfer nip portion TP which is the position at which the photosensitive drums 3BK, 3M, 3Y, and 3C face the transfer rollers 66, 67, 68, and 69 respectively, as the paper is conveyed to the left in the figures by the paper conveyor belt 6. Thus, a layered toner image 72 as shown in FIG. 3(*b*) is formed.

In transferring, a discharge (separation discharge) occurs within the toner image 72, due to the charges possessed by the toners. As a result, a reverse-charged toner image 73 whose upper layer portion is charged to the polarity (negative polarity) opposite to the regular charge polarity (positive polarity), is created as shown in FIG. 3(*a*). Even if the reverse-charging does not occur after the paper has passed the transfer nip portion TP, it is possible that reverse-charging could occur at the next transfer position when the next color is transferred to the paper. In other words, the amount of charge (potential) of the toner image is increased since the charge is imparted to the toner from the photosensitive drum 3 during the transfer. The reverse-charging occurs easily, especially when the transfer bias is applied, as the amount of charge on the toner image increases. This consideration can help explain the results of experiments.

Further, when the four developing units 51BK, 51M, 51Y, and 51C corresponding to four colors performs development sequentially, the magenta toner from the second developing unit 51M, which has been overlaid on the black toner from the first developing unit 51BK, is reverse-transferred to the third developing unit 51Y, as shown in FIG. 4. Similarly, the magenta toner and yellow toner from the second and third developing units 51M and 51Y, which have been overlaid on the black toner from the first developing unit 51BK, are reverse-transferred to the fourth developing unit 51C. It is determined that the second toner (magenta) and third toners (yellow) that are overlaid on the first black toner is reverse-transferred to the fourth developing unit 51C much larger than the first toner (black). Therefore, the first toner (black) has little adverse effect concerning reverse transfer to the second and subsequent developing units 51M, 51Y, and 51C.

By the way, muddying that is generated when the black toner is reverse-transferred has much effect on the image quality than muddying that is generated when the other colors (magenta, yellow, and cyan) are reverse-transferred. On the other hand, as is clear from FIG. 4, the toner that is reverse-transferred most easily is not the toner in the lowermost layer on the paper P but the toner in the second and subsequent layers that are overlaid thereon.

In the present embodiment, the black toner from the first developing unit 51BK is transferred to the paper firstly, as described previously. Since the black toner that has much effect on the muddying is transferred firstly, the muddying caused by the black toner is suppressed, causing the image quality to be improved.

Substantially spherical particles that have a high fluidity and good transferability are used as the toner in the present embodiment. If the black toner that has above-described features is transferred onto the paper at the end of mixed-color black development, the black toner that has adhered to the uppermost layer is repulsed by the electrical field that is generated by the toner in the lower layers, due to the extremely high fluidity of the toner. As a result, the colors of the other toners are exposed, making it impossible to form a high-quality black image. However, the image-forming device according to the first embodiment can prevent this problem since the black toner is transferred onto the paper firstly.

With the simultaneous development/cleaning method (otherwise known as the cleanerless method) used in this embodiment, which necessitates reliable recovery of waste toner in the developing units without using any special cleaner, the effects of reverse transfer are greater than in a configuration in which a dedicated cleaner for recovering waste toner is provided. The yellow toner is transferred onto the paper thirdly in the present embodiment, since the toner that is transferred onto the paper thirdly is most likely to be reverse-transferred to the fourth developing unit 51C. Since the image quality with yellow toner is not as obvious as that with the other colors of toner (black, magenta, and cyan), the effects of reverse transfer is suppressed, even when the simultaneous development/cleaning method is used.

The description now turns to a second embodiment of this invention. Since the configuration of the image-forming device according to the second embodiment is basically the same as that of the first embodiment, further description of components that have the same reference numbers as those in the first embodiment is omitted and the description below concerns only differences from the first embodiment. In the second embodiment, similar to the first embodiment, the black toner is developed onto the paper P firstly, then the magenta, yellow, and cyan non-black toners are developed in the second to fourth places.

In the second embodiment, the total developer amount of the second and third toners (magenta and yellow) is less than the developer amount of the black toner in a mixed-color black development. More specifically, the amounts of each of the magenta, yellow, and cyan toners are equal and less than 50% with respect to 100% of black toner. The developer amount could be adjusted by giving the exposure devices 41 to 44 image data to form the latent electrostatic image of a density (dot spacing) corresponding to the developer amount (%) for each toner on the photosensitive drums 3BK, 3M, 3Y, and 3C. In other words, the developer amount is determined by a difference in density (dot area) of each color with respect to the region in which the black-colored image is formed on the paper P.

As described above, the amount of toner from the second developing unit 51M and third developing unit 51Y that is reverse-transferred to the fourth developing unit. 51C is larger than the amount of toner from the fourth developing unit 51C. However, the image-forming device according to the second embodiment restrains the total developer amount of the second and third toners (magenta and yellow) in mixed-color black development, thus preventing the effects of reverse transfer.

While the invention has been described in detail with reference to the specific embodiment thereof, it would be apparent to those skilled in the art that various changes and modifications may be made therein without departing from the spirit of the invention.

For example, the black-colored image may be formed by monochromatic black development with a single color of black toner. Such a case, the quality of the black-colored image formation is slightly degraded but deterioration of the quality due to reverse transfer can be prevented.

Only the black toner may be of a substantially spherical form, though all of the toners are of a substantially spherical form in the first embodiment.

The cyan toner is developed by the second developing unit and the magenta toner is developed by the fourth developing unit. Note that the toner of the fourth developing unit is preferably the toner that has the largest amount of toner adhering per unit area (M/A) of the corresponding photosensitive drum. This puts the largest reverse transfer to the fourth developing unit and can minimize the amount of reverse transfer of developer due to the second and third developing units.

The yellow toner may be developed by the second developing unit. It should be noted, however, that yellow toner is preferably used as the third developer, since the large amount of the toner from the third developer is reverse-transferred to the fourth developing unit.

In the above-described embodiments, an image-forming device that uses a "direct transfer method" is described, wherein a visible image (developer image) formed on each photosensitive drum 3 is directly transferred onto the paper P as the transfer recipient. However not limited thereto, an "intermediate transfer method" may be used for the image-forming device, wherein after the visible image formed on each photosensitive drum is transferred to an intermediate transfer body such as an intermediate transfer belt or an intermediate transfer drum as the transfer recipient (primary transfer), the image is transferred from the intermediate transfer body to paper (recording recipient). An OHP sheet may be used instead of the paper P. In addition, not limited to the tandem method, a four-cycle method in which each developing unit forms developer images on a common photosensitive drum can also be used.

Figure 5:
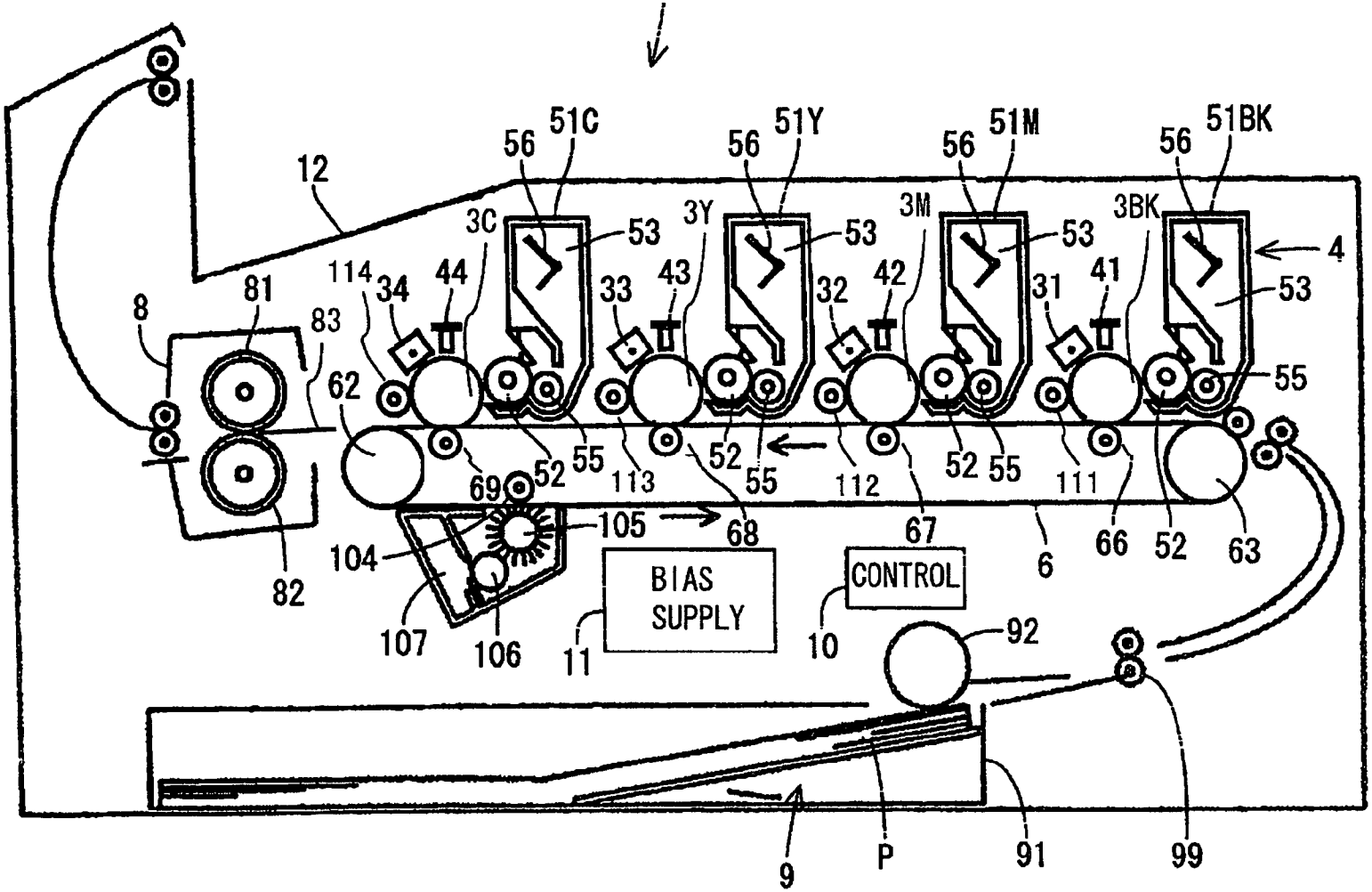
FIG. 5 is a section taken through the side of essential components of a color laser printer in a modification of the first embodiment.

A complex machine that is provided with a facsimile, a printing function, or scanner function may be used instead of the printer such as the color laser printer 1. The laser printer 1 may be provided with cleaning rollers 111-114 to clean up the photosensitive drums 3BK, 3M, 3Y, and 3C, as shown in FIG. 5.

What is claimed is:

1. An image-forming device comprising:

a plurality of image bearing members including 1st to $N_{th}$ image bearing members, N being an integer number greater than 3, the 1st to $N_{th}$ image bearing members having 1st to $N_{th}$ surfaces respectively, 1st to $N_{th}$ electrostatic latent images being formable on the 1st to $N_{th}$ surface respectively;

a plurality of developing units including 1st to $N_{th}$ developing units provided in one-to-one correspondence with the 1st to $N_{th}$ image bearing members, the 1st to $N_{th}$ developing units having 1st to $N_{th}$ monochromatic developers respectively, the 1st monochromatic developer being of monochromatic black and comprising a toner particle substantially spherical in shape, the 1st to $N_{th}$ monochromatic developers being superimposed one on the other in order to form a black image, the 1st to $N_{th}$ developing units developing the 1st to $N_{th}$ electrostatic latent images with the 1st to $N_{th}$ monochromatic developers respectively in order to form 1st to $N_{th}$ developer images respectively; and a transfer unit that transfers the 1st to $N_{th}$ developer images to a recipient in a superimposed manner in order of the 1st to $N_{th}$ developer image, wherein N is greater than 3 and the Nth monochromatic developer has the largest amount of adhering per unit area (M/A) among the monochromatic developers other than black.

2. The image-forming device according to claim 1, wherein the $N-1_{th}$ monochromatic developer is of monochromatic yellow.

3. The image-forming device according to claim 1, further comprising a cleaning member that removes residual developer that adheres to each image bearing member after each developer image is transferred to the recipient, wherein each developing unit develops each electrostatic latent image while removing the residual developer with the cleaning member.

4. An image-forming device comprising:

a plurality of image bearing members including 1st to 4th image bearing members, the 1st to 4th image members having 1st to 4th surfaces respectively, 1st to 4th electrostatic latent images being formable on the 1st to 4th surface respectively;

a plurality of developing units including 1st to 4th developing units provided in one-to-one correspondence with the 1st to 4th image bearing members, the 1st to 4th developing units having 1st to 4th monochromatic developers respectively, the 1st monochromatic developer being of monochromatic black, the 1st to 4th developing units developing the 1st to 4th electrostatic latent images with the 1st to 4th monochromatic developers respectively in order to form 1st to 4th developer images respectively, a total amount of the 2nd monochromatic developer on the 2nd surface and the 3rd monochromatic developer on the 3rd surface being less than an amount of the 1st monochromatic developer on the 1st surface; and a transfer unit that transfers the 1st to 4th developer images to a recipient in a superimposed manner in order of the 1st to 4th developer image in order to form a black image, wherein the 4th monochromatic developer has the largest amount of adhering per unit area (M/A) among the amounts of 2nd monochromatic developer to 4th monochromatic developer.

5. The image-forming device according to claim 4, wherein each amount of the 2nd monochromatic developer on the 2nd surface and the 3rd monochromatic developer on the 3rd surface is equal to or less than a half of the amount of the 1st monochromatic developer on the 1st surface.

6. The image-forming device according to claim 4, wherein the 2nd to 4th monochromatic developers are monochromatic yellow, monochromatic magenta and monochromatic cyan, and either the 2nd monochromatic developer or the 3rd monochromatic developer is monochromatic yellow.

7. The image-forming device according to claim 4, wherein the 3rd monochromatic developer is monochromatic yellow.

8. The image-forming device according to claim 4, further comprising a cleaning member that removes residual developer that adheres to the image bearing member after each developer image is transferred to the recipient, wherein the developing member develops each electrostatic latent image while removing the residual developer with the cleaning member.

9. An image-forming method comprising:

(a) forming 1st to $N_{th}$ electrostatic latent images on 1st to $N_{th}$ surfaces formed on 1st to $N_{th}$ image bearing members respectively, N being an integer greater than three;

(b) developing the 1st to Nth electrostatic latent images with 1st to Nth monochromatic developers respectively in order to form 1st to $N_{th}$ developer images respectively, wherein the $N-1_{th}$ monochromatic developer being monochromatic yellow;

(c) transferring the 1st to $N_{th}$ developer images to a recipient in a superimposed manner in order of the 1st to Nth developer image; and (d) removing residual developer that adheres to each image bearing member while developing each electrostatic latent image, wherein the Nth monochromatic developer has the largest amount of adhering per unit area (M/A) among the monochromatic developers other than the 1st monochromatic developer.

10. An image-forming device comprising:

at least one image bearing member on which a plurality of electrostatic latent images is formable;

a plurality of developing units including 1st to $N_{th}$ developing units, the 1st to $N_{th}$ developing units having 1st to $N_{th}$ monochromatic developers respectively, the 1st monochromatic developer being of monochromatic black and comprising a toner particle substantially spherical in shape, the 1st to Nth monochromatic developers being superimposed one on the other in order to form a black image, the 1st to $N_{th}$ developing units developing the plurality of electrostatic latent images with the 1st to $N_{th}$ monochromatic developers respectively in order to form 1st to $N_{th}$ developer images respectively; and a transfer unit that transfers the 1st to $N_{th}$ developer images to a recipient in a superimposed manner in order of the 1st to $N_{th}$ developer image, wherein N is greater than 3 and the Nth monochromatic developer has the largest amount of adhering per unit area (M/A) among the monochromatic developers other than the 1st monochromatic developer.

11. The image-forming device according to claim 10, wherein the $N-1_{th}$ monochromatic developer is of monochromatic yellow.

12. The image-forming device according to claim 10, further comprising a cleaning member that removes residual developer that adheres to each image bearing member after each developer image is transferred to the recipient, wherein each developing unit develops each electrostatic latent image while removing the residual developer with the cleaning member.

13. An image-forming device comprising:

at least one image bearing member on which 1st to 4th electrostatic latent images are formable;

a plurality of developing units including 1st to 4th developing units, the 1st to 4th developing units having 1st to 4th monochromatic developers respectively, the 1st monochromatic developer being of monochromatic black, the 1st to 4th developing units developing the 1st to 4th electrostatic latent images with the 1st to 4th monochromatic developers respectively in order to form 1st to 4th developer images respectively, a total amount of the 2nd monochromatic developer and the 3rd monochromatic developer on the image bearing member being less than an amount of the 1st monochromatic developer on the image bearing member; and a transfer unit that transfers the 1st to 4th developer images to a recipient in a superimposed manner in order of the 1st to 4th developer image in order to form a black image, wherein the 4th monochromatic developer has the largest amount of adhering per unit area (M/A) among the monochromatic developers other than the 1st monochromatic developer.

14. The image-forming device according to claim 13, wherein each amount of the 2nd monochromatic developer on the image bearing member and the 3rd monochromatic developer on the image bearing member is equal to or less than a half of the amount of the 1st monochromatic developer on the image bearing member.

15. The image-forming device according to claim 13, wherein the 2nd to 4th monochromatic developers are monochromatic yellow, monochromatic magenta and monochromatic cyan, and either the 2nd monochromatic developer or the 3rd monochromatic developer is monochromatic yellow.

16. The image-forming device according to claim 13, wherein the 3rd monochromatic developer is monochromatic yellow.

17. The image-forming device according to claim 13, further comprising a cleaning member that removes residual developer that adheres to the image bearing member after each developer image is transferred to the recipient, wherein the developing member develops each electrostatic latent image while removing the residual developer with the cleaning member.

18. An image-forming device comprising:

a plurality of image bearing members including 1st to $N_{th}$ image bearing members, N being an integer number greater than three, the 1st to $N_{th}$ image members having 1st to $N_{th}$ surfaces respectively, 1st to $N_{th}$ electrostatic latent images being formable on the 1st to $N_{th}$ surface respectively;

a plurality of developing units including 1st to $N_{th}$ developing units provided in one-to-one correspondence with the 1st to $N_{th}$ image bearing members, the 1st to $N_{th}$ developing units having 1st to $N_{th}$ monochromatic developers respectively, the $N-1_{th}$ monochromatic developer being monochromatic yellow, the 1st to $N_{th}$ developing units developing the 1st to $N_{th}$ electrostatic latent images with the 1st to $N_{th}$ monochromatic developers respectively in order to form 1st to $N_{th}$ developer images respectively;

a transfer unit that transfers the 1st to $N_{th}$ developer images to a recipient in a superimposed manner in order of the 1st to $N_{th}$ developer image; and a cleaning member that removes residual developer that adheres to each image bearing member after each developer image is transferred to the recipient, wherein each developing unit develops each electrostatic latent image while removing the residual developer with the cleaning member, wherein N is greater than 3 and the Nth monochromatic developer has the largest amount of adhering per unit area (M/A) among the monochromatic developers other than the 1st monochromatic developer.

* * * * *